United States Patent [19]

Carlson

[11] Patent Number: 4,759,736

[45] Date of Patent: Jul. 26, 1988

[54] FOLDING WING GLIDER

[75] Inventor: Paul Carlson, Urbana, Ill.

[73] Assignee: Off The Ground Models, Inc., Lawrenceville, Ill.

[21] Appl. No.: 828,619

[22] Filed: Feb. 11, 1986

[51] Int. Cl.[4] ..... A63H 27/00

[52] U.S. Cl. ..... 446/62

[58] Field of Search ..... 446/62, 61, 63, 64, 446/66, 67, 68

[56] References Cited

U.S. PATENT DOCUMENTS

| | | | |
|---|---|---|---|
| 1,974,656 | 6/1933 | Nelson | 46/50 |
| 2,128,747 | 8/1938 | Johnson | 446/63 X |
| 2,145,972 | 2/1939 | Clark et al. | 446/62 |
| 2,158,377 | 5/1939 | O'Hare | 446/62 |
| 2,166,564 | 3/1936 | Atwood et al. | 244/49 |
| 2,289,224 | 2/1940 | Swanson et al. | 244/49 |
| 2,290,850 | 10/1940 | Umschweif | 244/49 |
| 2,417,267 | 3/1947 | Porter | 446/62 |
| 3,187,460 | 6/1965 | Robertson | 446/61 |
| 3,222,817 | 12/1965 | Brandstetter | 46/80 |
| 3,369,319 | 2/1968 | Brown | 446/64 X |
| 3,408,767 | 11/1968 | Anderson | 446/62 |
| 3,452,471 | 7/1969 | Street | 446/63 |
| 3,744,741 | 7/1973 | Christan et al. | 446/62 |
| 3,943,657 | 3/1976 | Leckie | 46/80 |
| 4,292,757 | 10/1981 | Cahen, Jr. | 46/80 |
| 4,324,064 | 4/1982 | Bettencourt et al. | 446/64 |

FOREIGN PATENT DOCUMENTS

| | | | |
|---|---|---|---|
| 739477 | 9/1943 | Fed. Rep. of Germany | 446/62 |
| 201484 | 6/1958 | Fed. Rep. of Germany | 446/61 |
| 2308958 | 2/1973 | Fed. Rep. of Germany | 446/62 |
| 3109429 | 9/1982 | Fed. Rep. of Germany | 446/61 |
| 458228 | 7/1950 | Italy | 446/62 |
| 499097 | 11/1954 | Italy | 446/62 |
| 1445835 | 8/1976 | United Kingdom | 446/62 |

*Primary Examiner*—Robert A. Hafer
*Assistant Examiner*—D. Neal Muir
*Attorney, Agent, or Firm*—Tilton, Fallon, Lungmus & Chestnut

[57] ABSTRACT

A folding wing hand launch glider having two modes of operation is disclosed. In one mode of operation a portion of the wings are retracted and so produce a reduced air resistance and lift, while in the other mode of operation the wings are fully outstretched so that the airplane glides. The first mode of operation is used for launching the glider and the second mode of operation represents normal flight. The outer tip portions of the wing is hinged and said portions are released to their fully outstretched positions, such as by command from radio control means after the glider is launched.

5 Claims, 2 Drawing Sheets

FIG. 4
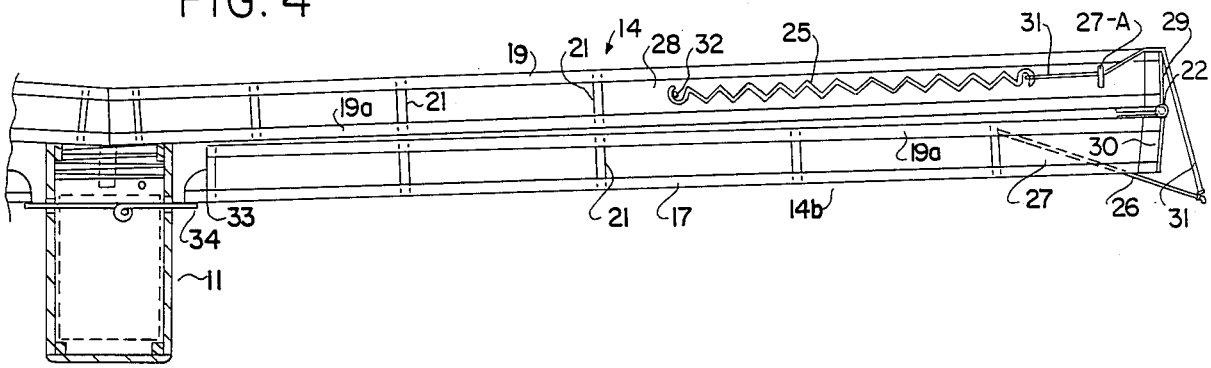
FIG. 5
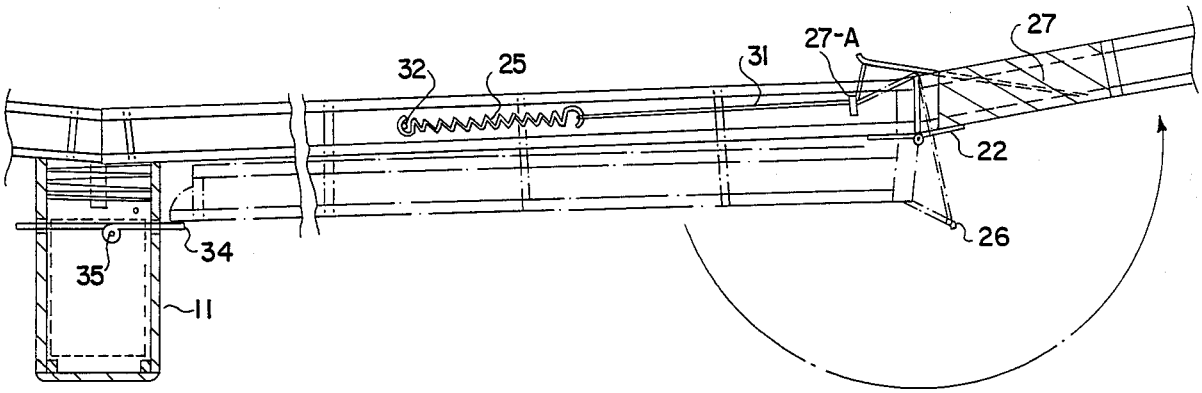
FIG. 8
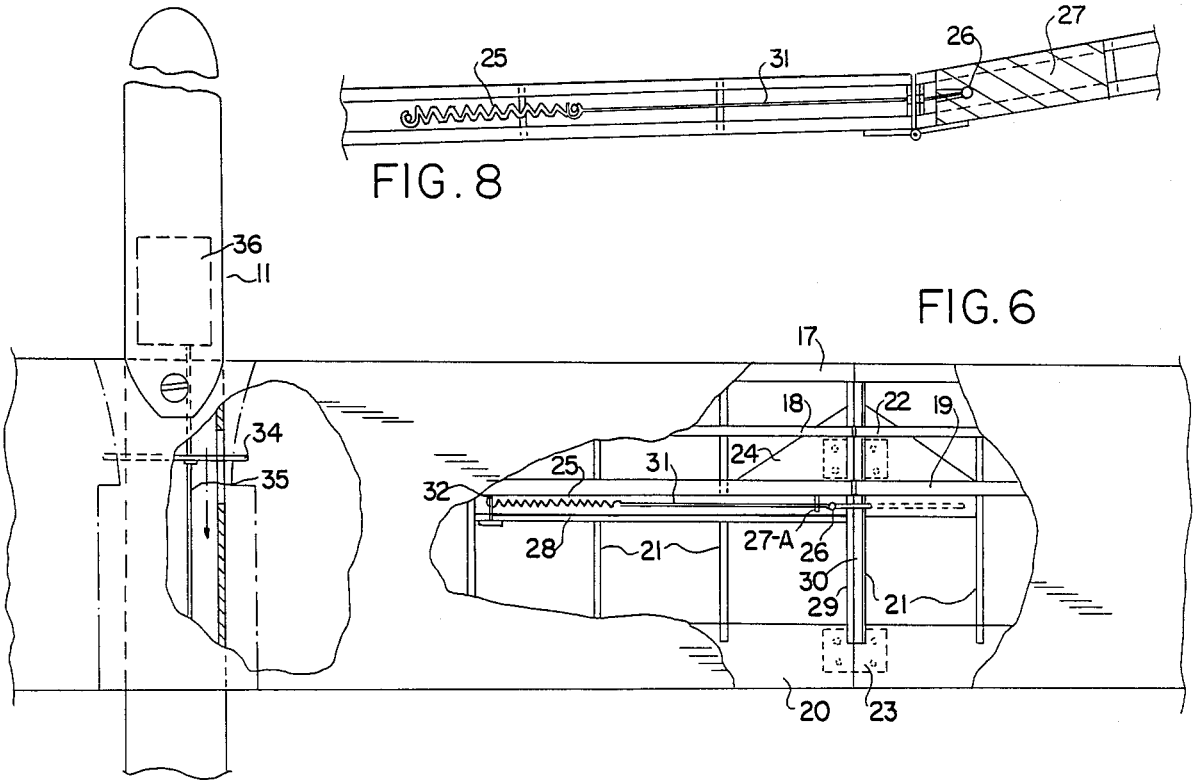
FIG. 6

FOLDING WING GLIDER

BACKGROUND OF THE INVENTION

The concept of the folding wing hand launch glider was devised in an attempt to overcome the problems associated with launching small gliders. The gliders have to be kept as light in weight as possible to fly well, but designers have found that by building the planes stronger and thus heavier they were able to launch the planes with a greater force which gave the plane more altitude and oftentimes longer flights.

When a conventional fixed wing hand launch glider is thrown hard in an attempt to gain more altitude from the launch, the wings produce much more lift than the plane needs. Since the lift of a wing increases to the square of the velocity, increased velocity at launch means more lift which tends to cause the glider to loop in the air. To keep the glider on the desired launch path, the elevator must be applied downwardly to counteract the extra lift of the wing. The resulting configuration of the flying surfaces produces a large amount of drag which slows the aircraft and wastes a large amount of the kenetic energy transferred to the plane during the launch. Not only is extra drag produced, but the wings are stressed much more than normal. In order for the wings to survive such stressful launches they have to be made stronger which in turn means the gliders are going to be heavier.

There is a definite need for a lightweight hand launch glider having reduced drag during launch and also having the capability of being launched with great force without causing unwanted looping.

SUMMARY OF THE INVENTION

It is an object of this invention to produce a lightweight model glider than can withstand a great force when launched and will not tend to loop in the air during launch.

Another object of the present invention is to provide a hand launch glider which has flying surfaces which do not produce a large amount of drag during launch.

Yet another object of the present invention is to produce a folding wing hand launch glider in which upon launching, portions of the wing are retracted and after launching said portions may be released by radio control means to fully extend the wings for normal flight.

The present invention relates to a folding wing hand launch glider or sail plane which overcomes the traditional problems associated with launching model gliders while gaining higher altitudes upon launching. The folding wing hand launch glider comprises a fuselage, a plurality of wings, each of said wings having outboard wing panels and inboard wing panels, the outboard wing panels capable of being folded underneath the inboard wing panels by hinge means, and with the outboard wing panels being held in place by a releasable pin. With this configuration, the flyer may launch the glider with great force without stressing the wings or looping the plane. Before the apex of the launch, the flyer may release the outward wing panels by radio control means to fully extend the wings thereby converting the remaining speed into extra height. At this point, the glider is free to perform as a conventional hand launch glider but would do so starting at a much higher altitude thereby resulting in longer times of flight.

DESCRIPTION OF THE DRAWINGS

FIG. 4 shows a detailed rear section view of a wing, with the outboard wing panel folded underneath the inboard wing panel, but otherwise similar to FIG. 5.

FIG. 5 shows a rear section view taken at line 5—5 of FIG. 2 of a wing exhibiting the releasing means of the outboard wing panel from the inboard wing panel.

FIG. 6 shows a top sectional view of a wing disclosing hinging means and release means for the outboard wing panel.

FIG. 8 shows a front sectional view of a wing disclosing alternate releasing means.

DETAILED DESCRIPTION OF THE INVENTION

Figure 2:
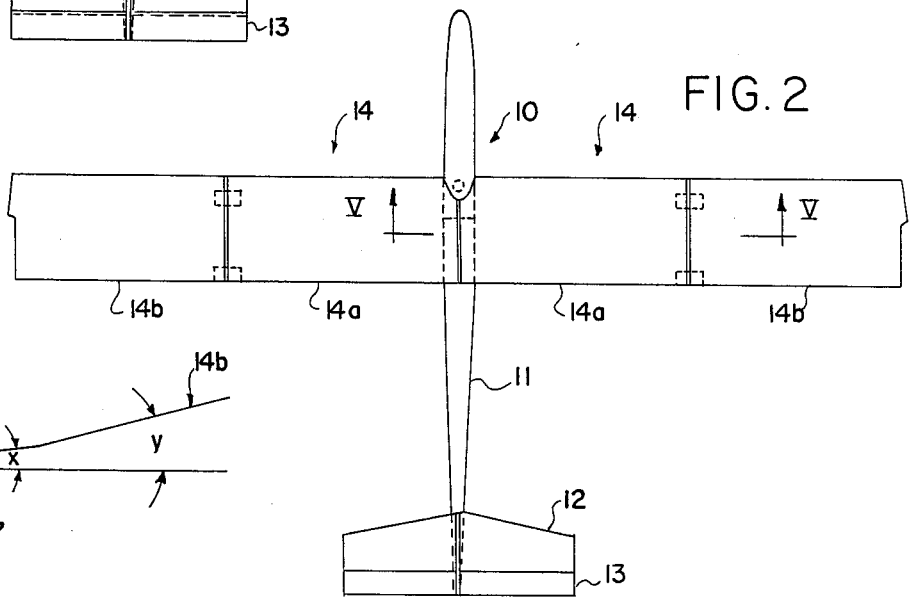
FIG. 2 shows a top plan view of the folding wing hand launch glider with the outboard wing panels extended.

Referring initially to FIG. 2, the numeral 10 refers generally to the model glider of this invention. The glider 10 has fuselage 11, stabilizer 12, elevator 13 and wings 14. Each wing comprises an inboard panel 14*a* and outboard panel 14*b*. The glider 10 may be constructed of balsa wood in a well known manner and covered with any suitable flexible sheet material. Of course, other lightweight materials may be utilized for the structure and covering depending upon the preference of the model builder.

Figure 1:
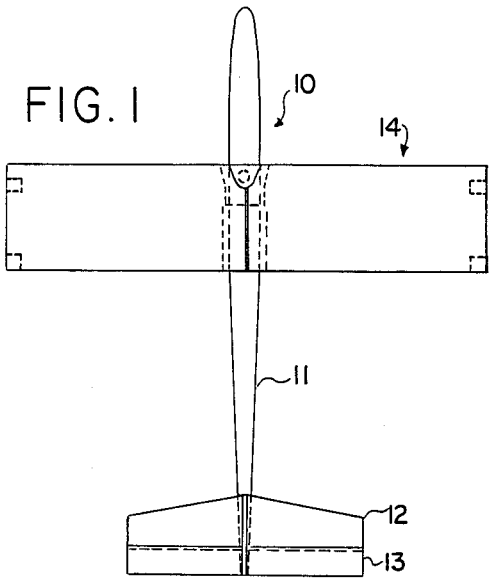
FIG. 1 shows a top plan view of the folding wing hand launch glider of the present invention with outboard wing panels retracted, i.e. folded underneath the inboard wing panels.
Figure 9:
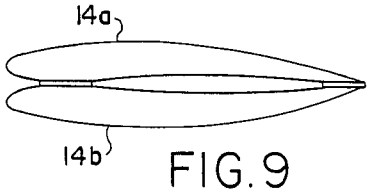
FIG. 9 shows a side elevational view from the end of a folded wing showing the outboard wing panel folded underneath the inboard wing panel.
Figure 10:
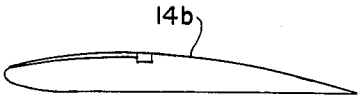
FIG. 10 shows a side elevational view of the tip end of a fully extended wing.

While FIG. 2 shows the outboard wing panels 14*b* fully extended for normal flight, i.e. placed in the flight position, FIG. 1 shows a top plan view of glider 10 in the launch position in which the outboard wing panels 14*b* are folded underneath the respective inboard wing panels 14*a*. The wings 14 thus may be folded for purposes of launching the glider 10 by hand or other means or for purposes of storage, transportation, etc. The wings 14 in the folded or retracted position are generally referred to as being in the launch position.

Figure 3:
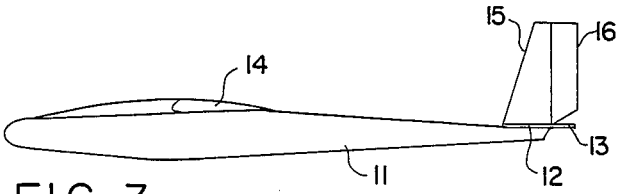
FIG. 3 shows a side elevational view of the folding wing hand launch glider of FIG. 2.

FIG. 3 shows a side elevational view of glider 11 disclosing fin 15 and rudder 16.

Figure 7:
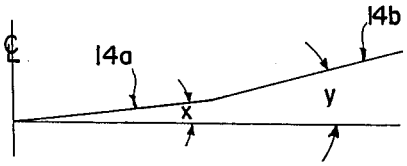
FIG. 7 shows the respective angles of the wing sections off horizontal.

The preferred embodiment of the folding wings 14 is shown in FIGS. 4, 5 and 6. Front strut 17 runs parallel to other structural strut members 18, 19 and 20 in the wing. All parallel structural members abut and are rigidly connected to spar plate members 21 to provide rigid support for wing 14. Front strut 17 is adjacent the forward or leading edge of wing 14, structural member 18 is located near the top center of the wing, structural member 19 provides support at the top center of the wing, structural member 19*a* (see FIG. 4) provides support at the bottom center of the wing, directly underneath member 19. Structural member 20 secures the back sides of spar members 21 to provide support to wing 14, and provide the customary trailing knife edge shape to wing 14. Pairs of hinges 22 and 23 connect inboard wing panel 14*a* with outboard wing panel 14*b* at abutting end spar plates 29, 30. The front hinges 22 are mounted on respective support blocks 24. The wings panels 14*a* and 14*b* are so connected (through hinges 22, 23 and abutting spar plates 29, 30) as to form a polyhedral joint connection (see FIGS. 5 and 7), in which angle "X" is preferably, approximately 5 degrees and angle "Y" is approximately 10 degrees.

Wing panels 14*a* and 14*b* are further connected by releasable locking means to allow folding and unfolding of the wing panels. Extension spring 25 is connected via a flexible wire or thread 31 to a hooked pin 26 which is embedded in block 27 which in turn is secured between structural members 19 and 19*a*. Further, a spring support pin 32 is embedded into a shortened, parallel structural member 28 which abuts the ends of certain of the spar members 21 and extends to end plate 29 of inboard wing panel 14(*a*). The spring wire 31 connects the spring 25 with hook 26 and passes through support eyelet 27*a*.

As shown in FIG. 4, when outboard wing panel 14*b* is folded, outer striker tab 33 engages a release pin 34 carried in the fuselage 11. Release pin 34 is secured to the moveable cable 35 which controls movement of elevator 13 by radio control means 36 in the fuselage 11 of glider 10. Accordingly, in the launch position the outboard wing panels 14*b* are folded on the glider and the combined wing panels 14*a*, 14*b* offer minimal air resistance and little lift force so that the glider can be projected into the air at a great force. Preferably the glider is hand launched at an angle of 60 degrees off horizontal. Slightly before the glider 10 reaches the apex of its ascent or launch, the flyer may signal through his radio control means a command to move the elevator upwardly to sustain flight. With this command which rearwardly moves cable 35, the release pin 34 would disengage the striker tabs 33 of the outboard wing panel 14*b* so that the springs 25 would tighten and thread 31 would pull the outboard panels 14*b* to their fully extended flight position to allow the glider to sail. Upon landing, the wing panels 14*b* can be easily retracted into the launch position for another take off. Wing panels 14*b* are simply folded downwardly until the tabs 33 securely engage release pins 34. The glider 10 is then ready for another hand launch.

FIG. 8 shows an alternate embodiment wherein the connecting hook pin 26 is embedded in block 27, within the confines of the wing 14*b*, i.e. pin 26' does not extend outwardly from the upper surface of wing panel 14*b* as does pin 26 in the preferred embodiment (see FIG. 5). Otherwise, pin 26' is connected via wire 31 to spring 25 and operates wing panel 14*b* in a similar fashion.

It will be understood that the above description of the present invention is susceptible to various modifications, changes and adaptations.

What is claimed is:

1. A folding wing glider comprising in combination:

a fuselage having a length;

a plurality of wings attached to said fuselage, each of said wings having an upper surface, each of said wings including an inboard wing panel and an outboard wing panel of generally equal size connected thereto said outboard wing panels foldable downwardly away from said upper surface of said inboard wing panel and underneath the respective said inboard wing panels to thereby be placed in a locked launch position, said folding with respect to a hinge axis, said hinge axis being generally parallel to said fuselage length; and releasable locking means to controllably release said outboard wing panels from said folded launch position into an extended flight position.

2. The folding wing glider as described in claim 1 wherein each said outboard wing panel is hingedly mounted on said inboard wing panel.

3. The folding wing glider as described in claim 2 wherein each flexible connector means and spring means cooperate with said hingedly mounted outboard wing panel to extend the same from a locked position downward and in direct alignment underneath said inboard wing panel.

4. The folding wing glider described in claim 3 wherein, when said outboard wing panel is folded downwardly and locked underneath said inboard wing panel, said spring means is stretched, and further, upon a controlled release of said outboard wing panel said sping means and said flexible connector means urge said outboard wing panels into said extended flight portion.

5. The folding wing glider of claim 1, wherein said releasable locking means comprises movable pin means engageable with the outer tips of said outboard wing panels when foldably placed in said launch position, said movable pin means operable to be controllably moved as desired to effect release of said outboard wing panels.

* * * * *